US006287221B1

(12) United States Patent
Pino

(10) Patent No.: US 6,287,221 B1
(45) Date of Patent: Sep. 11, 2001

(54) BASEBALL BAT ARTICLE

(76) Inventor: Scott A. Pino, 6071 Domarray St., Coopersburg, PA (US) 18036

( * ) Notice: Subject to any disclaimer, the term of this patent is extended or adjusted under 35 U.S.C. 154(b) by 0 days.

(21) Appl. No.: 09/440,129

(22) Filed: Nov. 15, 1999

(51) Int. Cl.[7] ..... A63B 59/06
(52) U.S. Cl. ..... 473/564; 156/309.6
(58) Field of Search ..... 473/564–568, 473/457, FOR 164, FOR 170; 101/33–36, DIG. 39; 156/308.2, 309.6, 277; 347/2

(56) References Cited

U.S. PATENT DOCUMENTS

| | | | | |
|---|---|---|---|---|
| 2,804,339 | * | 8/1957 | Kelly et al. | 473/564 |
| 3,940,864 | | 3/1976 | Kanzelberger . | |
| 4,012,552 | | 3/1977 | Watts . | |
| 4,125,655 | | 11/1978 | Kanzelberger . | |
| 4,241,115 | * | 12/1980 | Temin | 473/564 |
| 4,267,224 | | 5/1981 | Kanzelberger . | |
| 4,520,064 | | 5/1985 | Kanzelberger . | |
| 4,644,630 | * | 2/1987 | Blum | 473/567 |
| 4,759,219 | * | 7/1988 | Cobb et al. | 473/457 |
| 5,190,829 | * | 3/1993 | Nybye | 473/564 |
| 5,281,976 | | 1/1994 | Imai et al. . | |
| 5,303,917 | * | 4/1994 | Uke | 473/567 |
| 5,609,964 | | 3/1997 | Ogawa et al. . | |
| 5,735,094 | | 4/1998 | Zember . | |
| 5,779,840 | | 7/1998 | Boris . | |
| 5,814,579 | | 9/1998 | Dotson et al. . | |
| 5,820,438 | * | 10/1998 | Horton, III | 473/564 |
| 5,831,641 | * | 11/1998 | Carlson | 347/2 |
| 5,832,819 | | 11/1998 | Widman . | |

* cited by examiner

*Primary Examiner*—Mark S. Graham
(74) *Attorney, Agent, or Firm*—Blank Rome Comisky & McCauley, LLP

(57) ABSTRACT

A baseball bat article includes a baseball bat, a glossy finish coating material and an image-carrying transfer element. The baseball bat has a grip portion, a barrel portion and an intermediate portion interposed between the grip portion and the barrel portion. The baseball bat extends along a central axis to define a bat length. The glossy finish coating material is applied to the baseball bat to form a glossy finish, at least along the bat length. The image-carrying transfer element is fabricated from a transparent sheet material. Further, the image-carrying transfer element is defined by an outer periphery and has a first surface and an opposite second surface with a photographic image formed on either the first or second surface. The image-carrying transfer element is imperceptibly affixed to the baseball bat at a selected location along the bat length with either the first or second surface in contact with the baseball bat.

23 Claims, 3 Drawing Sheets

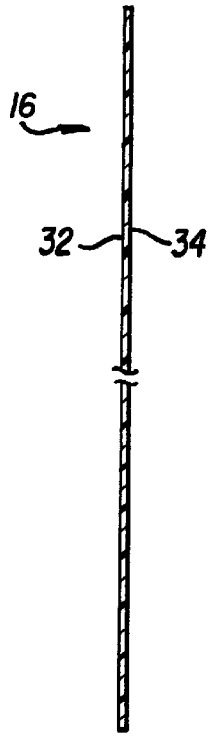
FIG. 2
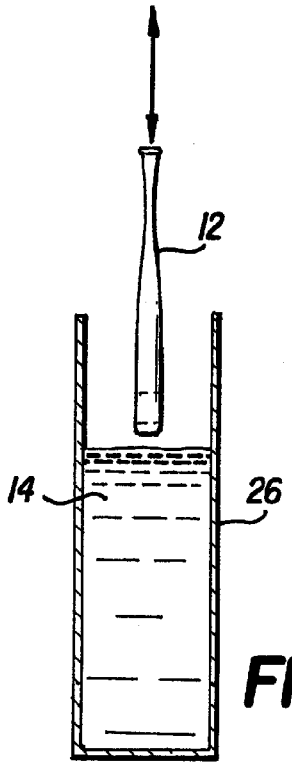
FIG. 4
FIG. 6
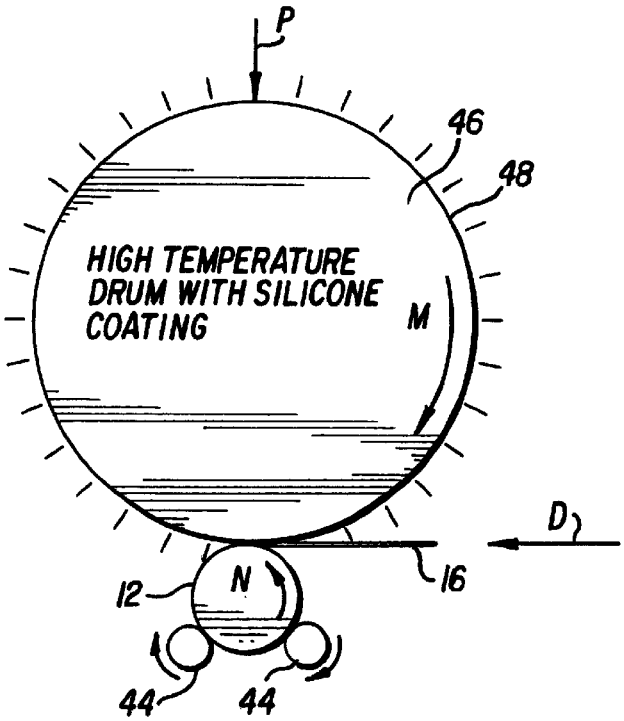

BASEBALL BAT ARTICLE

FIELD OF THE INVENTION

The invention is directed to a baseball bat article. More particularly, the invention is related to a baseball bat article having a decorative image thereon.

BACKGROUND OF THE INVENTION

Professional baseball has been considered America's favorite pastime for decades. Not only do baseball fans enjoy the performance of the professional baseball players but also imbibe in stadium refreshments and consume popcorn, peanuts and hotdogs. Sometimes, fans commemorate their attendance at a baseball game by buying souvenirs. One popular souvenir is a miniature baseball bat.

Miniature souvenir baseball bats have been sold in baseball parks for many years. One manufacturing company, Coopersburg Handle Works, had manufactured miniature souvenir baseball bats and sold them in ballparks during the 1940's and 1950's. Typically, these miniature souvenir baseball bats were sold in professional baseball parks with different variations of team logos or other decorative art, such as animations or cartoons. Usually, these miniature souvenir baseball bats were manufactured using either one color screen printing or foil stamping.

Presently, full-color logo designs are being applied to miniature souvenir baseball bats. Although these designs are greatly enhanced over the traditional one-color or foil-stamped miniature souvenir baseball bats, not many miniature souvenir baseball bats have been sold with a baseball player's image on the bat, until lately.

One company manufactures a miniature souvenir baseball bat with a baseball player's image formed thereon. The image is transferred onto the bat via a conventional non-contact image transfer (ncit) process. Generally, this process is an ink-jet process that sprays the image onto the bat using colored ink. The image generated by the ncit process reasonably portrays the image of the baseball player. However, the colors tend to lack luster i.e. dull in appearance and the quality of the image is significantly less than a photographic image, particularly in the image sharpness.

The invention overcomes these problems.

OBJECTS AND SUMMARY OF THE INVENTION

It is an object of the invention to provide a baseball bat having the image transferred thereon with substantially photographic quality colors and photographic quality sharpness.

Yet another object of the invention is to provide a baseball bat with an image transferred thereon using a transfer element that is imperceptibly affixed to the baseball bat.

Accordingly, a baseball bat article of the invention is hereinafter described. The baseball bat article of the invention includes a baseball bat, a glossy finish coating material and an image-carrying transfer element. The baseball bat has a grip portion, a barrel portion and an intermediate portion interposed between the grip portion and the barrel portion. The baseball bat extends along a central axis to define a bat length.

The glossy finish coating material is applied to the baseball bat to form a glossy finish, at least along the bat length. The image-carrying transfer element is fabricated from a transparent sheet material which is defined by an outer periphery and has a first surface and an opposite second surface. A photographic image is formed on either the first surface or the second surface. The image-carrying transfer element is affixed to the baseball bat at a selected location along the bat length with one of the first and second surfaces in contact with the baseball bat.

Another embodiment of the invention is a baseball bat article that is fabricated from a method that includes the steps of providing a baseball bat having a glossy finish coating and a blank, glossy transfer element fabricated from the transparent material; transferring a photographic image on to the transfer element; and, affixing the transfer element with the transferred photographic image onto the baseball bat in a manner such that the transfer element appears to be integrally formed with the baseball bat.

Other objects and advantages of the invention will become apparent from the following description of the embodiments taken in conjunction with the accompanying drawings.

BRIEF DESCRIPTION OF THE DRAWINGS

FIG. 2 is a cross-sectional side elevational view of the transfer element taken along line 2—2 in FIG. 1.

FIG. 4 is a diagrammatic view of a dipping process for applying a glossy finish coating material to the baseball bat.

FIG. 6 is a diagrammatic view of the transfer element being affixed to the baseball bat using a drum under pressure and with a high temperature.

DETAILED DESCRIPTION OF THE INVENTION

Figure 1:
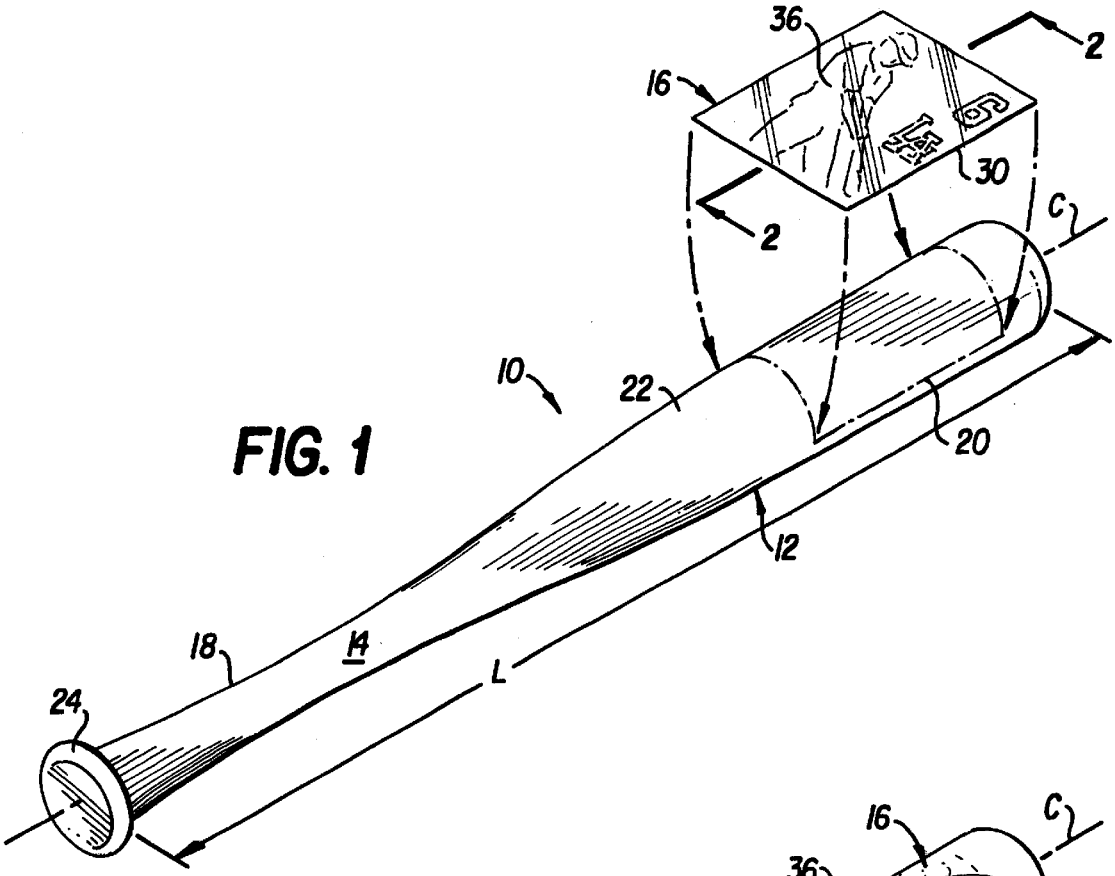
FIG. 1 is an exploded perspective view of a baseball bat article of the invention with a transfer element having an image ready to be affixed to a baseball bat.
Figure 3:
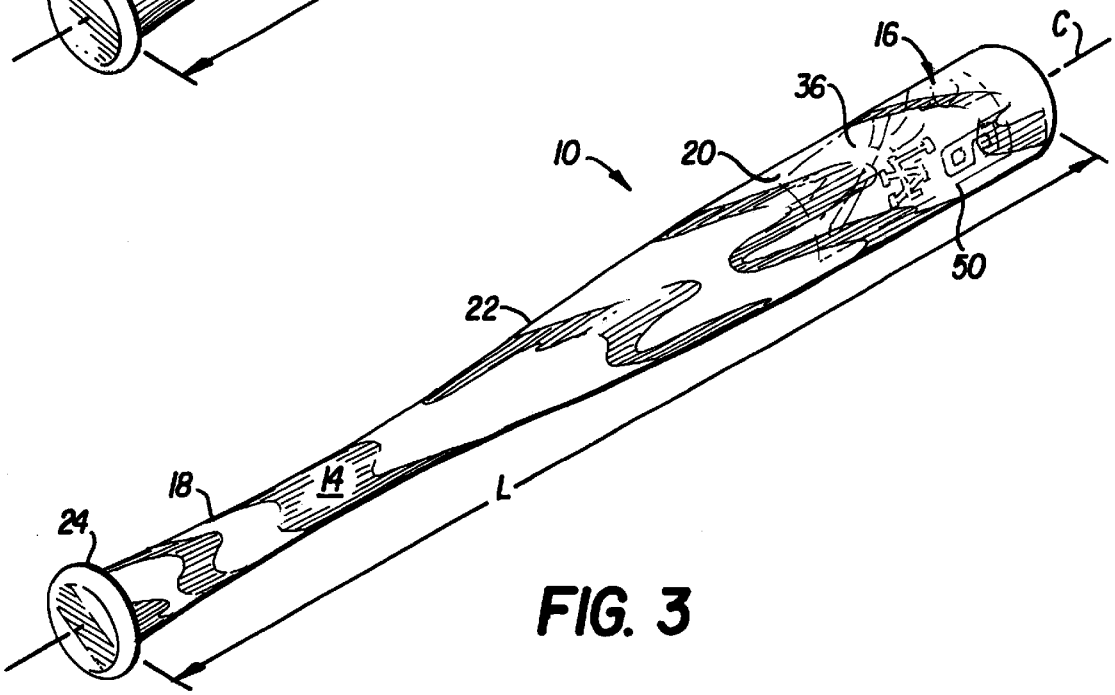
FIG. 3 is a perspective view of the baseball bat article of the invention with the transfer element having an image affixed to the baseball bat.

A baseball bat article 10 of the invention is introduced in FIGS. 1–3. The baseball bat article 10 includes a baseball bat 12, a glossy finish coating material 14 and a transfer element 16. The baseball bat 12 is fabricated from any suitable material, such as wood or metal. Typically, ash is selected for wooden baseball bats while aluminum is selected for metal baseball bats. Further, although the description proceeds using an American baseball bat, other bats, such as cricket bats, can also be used.

In FIG. 3, the baseball bat 12 has a grip portion 18, a barrel portion 20 and an intermediate portion 22 interposed between the grip portion 18 and the barrel portion 20. Also, the baseball bat 10 includes a knob 24 connected to an end of the grip portion 18. As shown in FIGS. 1 and 3, the baseball bat 12 extends along a central axis "C" to define a bat length "L".

As best shown in FIG. 4, the glossy finish coating material 14 is applied to the baseball bat 12 in a liquid form. The glossy finish coating material 14 is contained in a tank 26 and is applied to the baseball bat 12 via a conventional dipping process. As is commonly known in the art, the baseball bat 12 is submersed in the tank 16 filled with the glossy finish coating material 14 and, thereafter, the dipped baseball bat 12 is hung on a drying rack (not shown) to cure.

In FIGS. 1 and 2, the transfer element 16 is fabricated from a transparent sheet material such as plastic or polyester film. Preferably, the transparent sheet material is Mylar® which is a registered trademark of E.I. Du Pont De Nemours and Company located in Wilmington, Del. However, it is preferred that the transparent sheet material is glossy coated. Also, the Mylar® is coated with an acrylic solution as discussed below.

Again, with reference to FIGS. 1 and 2, the transfer element 16 is defined by an outer periphery 30 and the transfer element 16 has a first surface 32 and an opposite second surface 34. Additionally, a photographic image 36 is formed on either the first surface 32 or the second surface 34. The term "photographic image" is defined as an image having similar qualities of color and sharpness of a conventional photograph. SiCal Inc. of Natick, Mass., is one vendor that provides the transfer element 16 with the photographic image 36 formed thereon and uses conventional photographs to produce the transfer elements for the invention. As best shown in FIG. 3, the transfer element 16 is affixed to the baseball bat 12 at a selected location along the bat length "L". Either the first surface 32 or the second surface 34 contacts the baseball bat 12. Preferably, the photographic image 36 is formed on the surface that contacts the baseball bat 12. With the transfer element 16 affixed to the baseball bat 12, the transfer element 16 appears integrally formed with the baseball bat 12. Further, the outer periphery 30 of the transfer element 16 is imperceptible, visually or tactilely.

As shown in FIG. 3, the transfer element 16 is affixed to the baseball bat 12 on the barrel portion 20. However, one of ordinary skill in the art would appreciate that any selected location along the bat length "L" can be used to affix the transfer element 16. Particularly, the transfer element 16 can be affixed to the grip portion 18, to the intermediate portion 22, to partially the grip portion 18 and partially the intermediate portion 22 and to partially the barrel portion 20 and partially the intermediate portion 22.

Preferably, the glossy finish coating material 14 is a conventional laquer, preferably, water-borne. One of ordinary skill in the art would appreciate that the glossy finish coating material 14 can also be a polyethylene, varnish or other suitable glossy finish coating material.

The transfer element 16 is affixed to the baseball bat 12 by a heated roller process discussed in more detail below. Generally, the heated roller process heats the transfer element 16 and the baseball bat 12 to a temperature sufficient to cause the transfer element 16 to adhere to the baseball bat 12.

With reference to FIGS. 1 and 3, the photographic image 36 includes a person and alpha-numeric characters. However, a skilled artisan would appreciate that the photographic image can include a cartoon character or only a person or only alpha-numeric characters. However, for the embodiment of the baseball bat article of the invention, the photographic image 36 is a uniformed baseball player in a batting stance. Further, although not by way of limitation, the photographic image 36 of the uniformed baseball player fades adjacent the outer periphery 30 of the transfer element 16. It is theorized that such fading causes the photographic image 36 to blend into the baseball bat. Mountain Graphix Inc. of Glenndale Heights, Ill., is a vendor that provides the graphic appearance of the transfer element with the photographic image.

Figure 5:
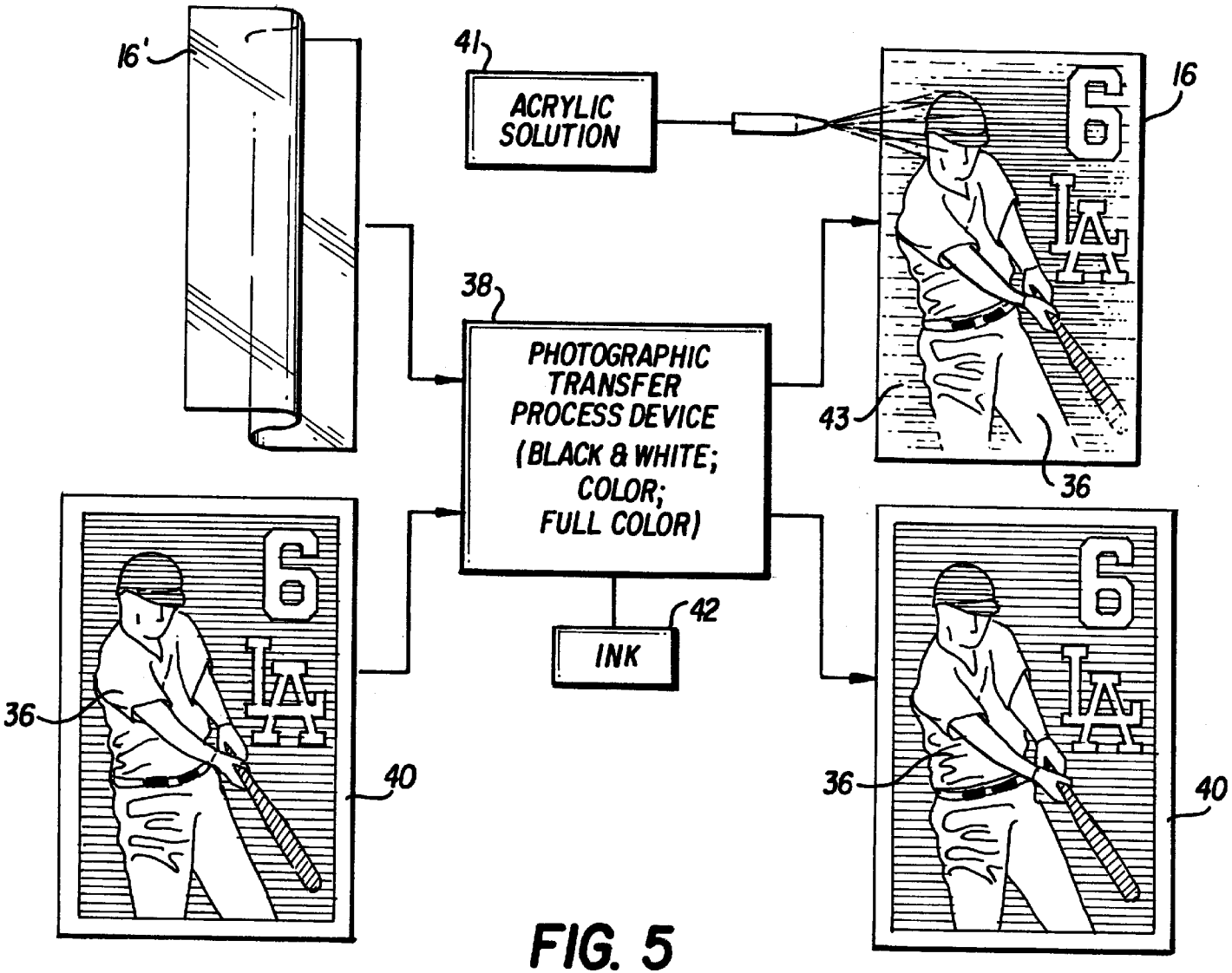
FIG. 5 is a diagrammatic view of a photographic transfer process wherein the image of a conventional photograph is transferred onto the transfer element.

In FIG. 5, a conventional photographic transfer process device 38 is used to transfer the photographic image 36 from a conventional photograph 40 onto a blank transfer element 16'. Preferably, the blank transfer element 16" is fabricated from a transparent glossy material. Further, it is preferred that the photographic transfer process device 38 is capable of transferring a full-color photographic image from the photograph 40 onto the blank transfer element 16'. However, one of ordinary skill in the art would appreciate that the photographic transfer process device 38 would also be capable of transferring black and white photographic images as well as color photographic images onto the blank transfer element 16'. Thus, the photographic image 36 formed on the transfer element 16 represents either a black and white photographic image, a color photographic image or a full-color photographic image. Further, it is preferred that the photographic image 36 transferred onto the transfer element 16 appears substantially identical to the photographic image so that the photographic image 36 formed on the transfer element 16 substantially retains the photographic qualities of the photograph 40, particularly in lust of color and sharpness of the image itself.

After the photographic transfer process is completed, the transfer element 16 with the photographic image 36 formed thereon is coated with an acrylic solution 41 to form an acrylic coating 43 on the transfer element 16. A skilled artisan would appreciate that the transfer element 16 is coated with the acrylic solution 41 before affixing the transfer element 16 onto the baseball bat 12. Upon heating the acrylic coating 43 when affixing the transfer element 16 to the baseball bat 12, a permanent bond is formed between the baseball bat 12 and the transfer element 16.

Preferably, an ink 42 is used to form the photographic image 36 on the transfer element 16. Preferably, the ink 42 is an industrial screen ink.

FIG. 6 represents a heated roller process that is used to affix the transfer element 16 onto the baseball bat 12. The baseball bat 12 is supported by a pair of support rollers 44. A high temperature drum 46 applies heat (represented by the dashes surrounding the high temperature drum 46) and a pressure represented by arrow "p" to the baseball bat 12. The high temperature is selected from a range between approximately 400° F. and 600° F. and the pressure is selected from a range between approximately 20 and 30 pounds per square inch. A desired combination of temperature and pressure is 420° F. and 25 pounds per square inch, respectively. The transfer element 16 formed with the photographic image 36 is fed between the high temperature drum 46 and the baseball bat 12 in a direction represented by arrow "D". Preferably, the high temperature drum 46 includes an outer surface 48 having a silicone coating. As the high temperature drum 46 rotates clockwise as represented by arrow "M" the baseball bat 12 rotates in a counter-clockwise direction as represented by arrow "N." As the transfer element 16 is fed between the high temperature drum 46 and the baseball bat 12, the transfer element 16, with the transferred photographic image, is affixed onto the baseball bat 12. The affixed transfer element 16 embeds into and bonds with the glossy finish coating material 14 which forms a substantially imperceptible interface 50 between the transfer element 16 and the glossy finish coating material 14 as shown in FIG. 3.

The heated roller process represented in FIG. 6 can be achieved using a hot stamping machine. Preferably, the hot stamping machine is Acromark Model 73RR from Acromark Industries, Inc., from Berkley Heights, N.J. The serial number for this hot stamping machine is 109422 and the model number is 730R-S.S.

Another embodiment of the invention is a method of fabricating the baseball bat article. One step provides the baseball bat having a glossy finish and a blank, glossy transfer element fabricated from the transparent material. The next step is transferring the photographic image onto the transfer element. Another step is affixing the transfer element with the transferred photographic image onto the baseball bat in a manner such that the transfer element appears to be integrally formed with the baseball bat. Under the affixing step, the transfer element, with the transferred photographic image, is embedded into the glossy finish coating material under a sufficient temperature and pressure, as defined above, to form an imperceptible interface between the transfer element and the glossy finish coating material. The range of temperature and pressure is discussed above.

The method might also include the step of causing the photographic image to fade near the periphery of the transfer element. Also, the step of transferring the photographic image on the transfer element can be achieved by a full-color transfer process.

Further, a skilled artisan would appreciate that the transfer element with the photographic image formed thereon could first be affixed to the baseball bat and, thereafter, the glossy finish coating material could be applied to the baseball bat.

The baseball bat article 10 of the invention results in a baseball bat, whether miniature or regulation size, having a substantially photographic quality image formed thereon that appears integrally formed with the baseball bat. With such a photographic image, the colors have luster and the image itself is sharp.

Although the invention has been specifically described herein, it would be apparent to those skilled in the art to which the invention pertains that other variations and modifications of the invention shown herein may be made without departing from the spirit and scope of the invention.

I claim:

1. A baseball bat article, comprising:

a baseball bat having a grip portion, a barrel portion and an intermediate portion interposed between the grip portion and the barrel portion, the baseball bat extending along a central axis to define a bat length;

a glossy finish coating material applied to the baseball bat to form a glossy finish at least along the bat length; and a transfer element fabricated from a transparent sheet material and defined by an outer periphery, the transfer element having a first surface and an opposite second surface with a photographic image formed on one of the first and second surfaces, the transfer element affixed to the baseball bat at a selected location along the bat length with one of the first and second surfaces in contact with the baseball bat such that the periphery of the transfer element and the glossy finish coating material form an imperceptible interface.

2. A baseball bat article according to claim 1, wherein the affixed transfer element appears integrally formed with the baseball bat.

3. A baseball bat article according to claim 1, wherein the selected location is one of the grip portion, the barrel portion, the intermediate portion, partially the grip portion and partially the intermediate portion, and partially the barrel portion and partially the intermediate portion.

4. A baseball bat article according to claim 1, wherein the transfer element is affixed to the baseball bat by a heated roller process whereby heating and rolling the transfer element causes the transfer element to adhere to the baseball bat.

5. A baseball bat article according to claim 4, wherein the heated roller process occurs at an approximate temperature range of 400° F. and 600° F. and at an approximate pressure range of 20 and 30 pounds per square inch.

6. A baseball bat article according to claim 1, wherein the transparent sheet material is mylar.

7. A baseball bat article according to claim 6, wherein the transparent sheet material is glossy coated.

8. A baseball bat article according to claim 1, wherein the photographic image is formed on one of the first and second surfaces whichever is contacting the baseball bat.

9. A baseball bat article according to claim 1, wherein the photographic image fades adjacent the periphery of the transfer element.

10. A baseball bat article according to claim 1, wherein the photographic image includes one of a person, a cartoon character, alphanumeric characters, a combination of the cartoon character and the alphanumeric characters and a combination of the person and the alphanumeric characters.

11. A baseball bat article according to claim 10, wherein the person is a uniformed baseball player.

12. A baseball bat article according to claim 1, wherein the photographic image represents one of a black and white photographic image, a color photographic image and a full-color photographic image.

13. A baseball bat article according to claim 1, wherein the photographic image appears glossy.

14. A baseball bat article according to claim 1, wherein the photographic image is transferred onto the transfer element from an image on a conventional photograph whereby the transferred photographic image appears substantially identical to the image on the conventional photograph.

15. A baseball bat article according to claim 14, wherein the photographic image appears substantially identical to the image on the conventional photograph in at least one of color and sharpness.

16. A baseball bat article according to claim 1, wherein the glossy finish coating material is a water-borne lacquer coating material.

17. A baseball bat article according to claim 1, wherein the affixed transfer element is embedded into the glossy finish coating material to form an imperceptible interface between the transfer element and the glossy finish material.

18. A baseball bat article according to claim 17, further comprising the step of causing the photographic image to fade near a periphery of the transfer element.

19. A baseball bat article according to claim 17, wherein the step of transferring the photographic image on the transfer element is achieved by a photographic transfer process.

20. A baseball bat article according to claim 17, wherein the step of affixing the transfer element onto the baseball bat is achieved by a heated roller process.

21. A baseball bat article according to claim 17, wherein the photographic image includes a baseball player.

22. A baseball bat article fabricated from a method comprising the steps of:

providing a baseball bat having a glossy finish coating material applied thereon and a blank, glossy transfer element fabricated from a transparent material;

transferring a photographic image onto the transfer element; and embedding the transfer element with the transferred photographic image into glossy finish coating material under a sufficient temperature and pressure to form an imperceptible interface between the transfer element and the glossy finish coating material.

23. A baseball bat article according to claim 22, wherein the photographic image includes a baseball player.

* * * * *